US005649760A

United States Patent [19]

Beadle

[11] Patent Number: 5,649,760

[45] Date of Patent: Jul. 22, 1997

[54] ADJUSTABLE LIGHTING FIXTURE

[76] Inventor: Joshua Z. Beadle, 5362 Caminito Vista Lujo, San Diego, Calif. 92130

[21] Appl. No.: 556,540

[22] Filed: Nov. 13, 1995

[51] Int. Cl.[6] ..... F21S 1/00

[52] U.S. Cl. ..... 362/270; 362/267; 362/287; 362/431

[58] Field of Search ..... 362/267, 269, 362/270, 287, 145, 427, 431, 153, 153.1

[56] References Cited

U.S. PATENT DOCUMENTS

| | | | |
|---|---|---|---|
| 4,360,859 | 11/1982 | Ziaylek, Jr. | 362/285 |
| 4,523,263 | 6/1985 | Poyer | 362/267 |
| 5,230,559 | 7/1993 | Porter et al. | 362/285 |
| 5,303,134 | 4/1994 | Cunado | 362/285 |
| 5,481,443 | 1/1996 | Wagner et al. | 362/267 |

OTHER PUBLICATIONS

FX Luminaire brochure, 1994, (4 pp.).

*Primary Examiner*—Ira S. Lazarus
*Assistant Examiner*—Sara Sachie Raab
*Attorney, Agent, or Firm*—Brown, Martin, Haller & McClain

[57] ABSTRACT

A lighting fixture includes a housing and a reflector assembly in the housing seated in a split, resilient seating ring and retained by a resilient retaining clip. The axial position of a reflector assembly may be adjusted by moving the seating ring axially. The ends of the ring on opposite sides of the split can be squeezed to resiliently disengage the ring from its interference-fit with the housing wall. The user squeezes the ring in this manner while moving it to a desired location in the housing and then releases it. The angular position of the reflector assembly may also be adjusted. The user squeezes the clip to resiliently disengage it from its interference-fit with the housing wall. The user squeezes the clip in this manner while pivoting the reflector assembly. With the ring abutting the reflector, the user then releases the clip to resiliently re-engage the housing wall. The lighting fixture may include a spike for securing the fixture in the ground.

17 Claims, 2 Drawing Sheets

ADJUSTABLE LIGHTING FIXTURE

BACKGROUND OF THE INVENTION

Environmental lighting, particularly outdoor lighting, is well known in commercial or public settings, such as parks and schools. Such lighting has also become increasingly popular for use in private homes, both to enhance the appearance and safety of the outdoor area and for security by eliminating hiding places and unobserved entry points for intruders.

Landscape and outdoor lighting systems include one or more lighting fixtures which are connected to either a 12 V transformer or a standard 120 VAC line. The lighting fixtures generally include a housing, a reflector assembly having a halogen or conventional bulb, and a lens or window. Many configurations are known, each of which provides a different lighting effect.

One of the more popular and versatile lighting fixtures utilizes a cylindrical housing attached to a pivoting knuckle joint, which allows the light to be directed at variable angles. The knuckle joint may be attached to a mounting brackets for attachment to structures, or placement of the fixtures can be as simple as sticking a tapered spike, which is attached to the pivoting joint, into the ground, so that no structures need to be modified to retain the fixture. Further, the use of a spike allows the fixtures to be placed within planters and lawn areas, and next to trees, away from structures.

While the pivoting joints provide significant adaptability in the aiming of the light, they are also the weakest point in the fixtures. The fixtures are subject to impact from gardening tools, children's toys, and persons inadvertently running into them. The joints are easy broken, particularly when they have exposed to moisture and other corrosive elements which attack the metal within the joint.

A reflector assembly, which is generally parabolic, is typically fixed within the end of the cylindrical housing nearest the open end, so that the light is emitted at a fixed angle from the fixture. The end of the cylinder is covered with a cap to protect the light source and electrical connections from the elements. The cap may include a lens and a cowling or glare shield to diffuse the beam and/or control the beam width to prevent the beam from shining directly into the eyes of individuals in the vicinity of the fixture. Nevertheless, glare control remains a problem and is considered to be the single most important factor in determining safety and aesthetics of any lighting project. A significant drawback to the use of hoods, tubular fittings which effectively lengthen the housing, is that they provide a trap for dirt and plant matter which can impair the fixture's light output as well as creating an environment that may actually speed up corrosion of the fixture. Other modifications, including internal baffles, may require modification of the lens or light source to allow the baffle to be inserted within the housing, possibly effecting the water-tight nature of the fixture. Besides the glare shields and baffles, directability of the fixture ,s important. However, much of this directability relies upon the pivot joints previously described.

It would be desirable to provide an economical light fixture that allows the beam angle and amount of glare and/or beam width to be adjusted without introducing components which result in premature failure of the fixtures. These problems and deficiencies arc clearly felt in the art and are solved by the present invention in the manner described below.

SUMMARY OF THE INVENTION

The present invention comprises a lighting fixture and method for adjusting its beam. The fixture comprises a hollow, elongated housing having a cylindrical portion in which are housed a reflector assembly, a seating ring, and a retaining clip. The seating ring is interference-fit within the housing interior wall. The reflector assembly is seated in the seating ring. The retaining clip is also interference-fit within the housing interior wall and abuts the reflector assembly to retain it in the seating ring. A transparent window, which may be a lens, is disposed at the end of the housing. In an exemplary embodiment, the window is disposed in a removable cap that covers an end of the cylindrical portion of the housing.

The position of the reflector assembly along the longitudinal axis of the housing may be adjusted by moving the seating ring axially. Moving the reflector away from the window decreases glare and narrows the beam. Moving the reflector toward the window maximizes the amount of light emitted and may broaden the beam. In an exemplary embodiment, the seating ring is a split, metal ring. The ends of The ring on opposite sides of the split can be squeezed to resiliently disengage the ring from its interference-fit with the housing wall. The user squeezes the ring in this manner while moving it to a desired location in the housing and then releases the ring to allow it to resiliently expand and thus re-engage the housing wall.

The angular position of the reflector assembly may also be adjusted. In an exemplary embodiment, the retaining clip is a metal wire bent into a circular shape. The ends of the wire may be bent to provide a grip for a user. The ends of the clip can be squeezed to resiliently disengage the clip from its interference-fit with the housing wall The user squeezes the clip in this manner while pivoting the reflector assembly within its seat in the split ring. With the clip still abutting the reflector, the user then releases the clip to resiliently expand and thus re-engage the housing wall.

The lighting fixture may include a spike for securing the fixture in the ground.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF PREFERRED EMBODIMENTS

Figures 1, 4:
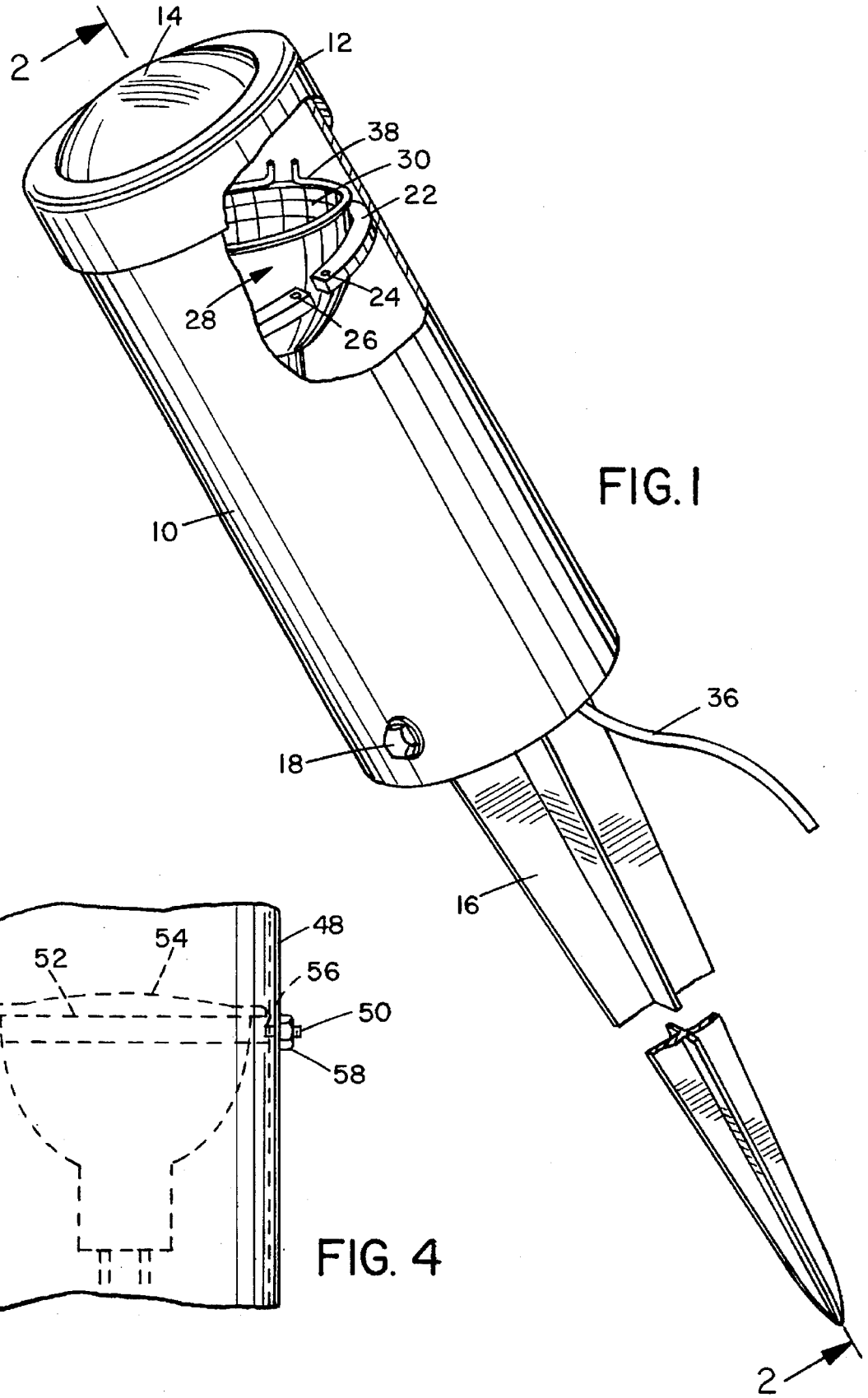
FIG. 1 is a perspective view, partially cut away, of the lighting fixture.
FIG. 4 is a partial side elevational view of an alternate embodiment of the invention.
Figure 2:
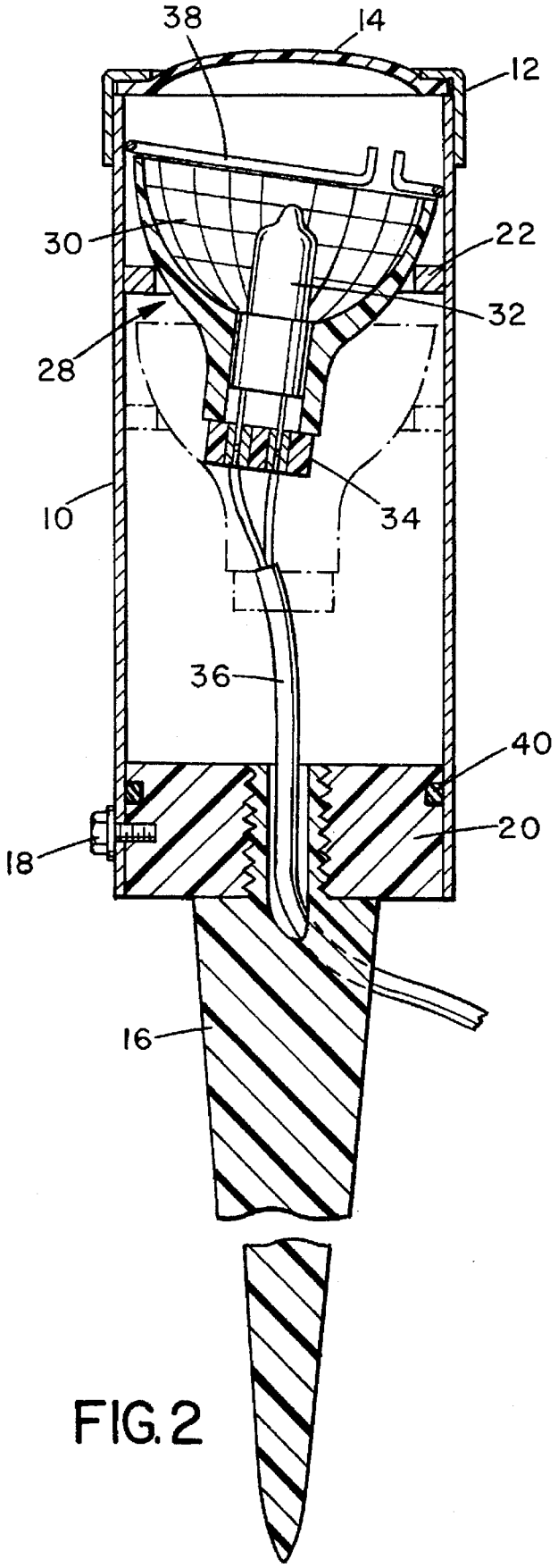
FIG. 2 is a sectional view taken on line 2—2 of FIG. 1, showing the adjustability of reflector assembly.
Figure 3:
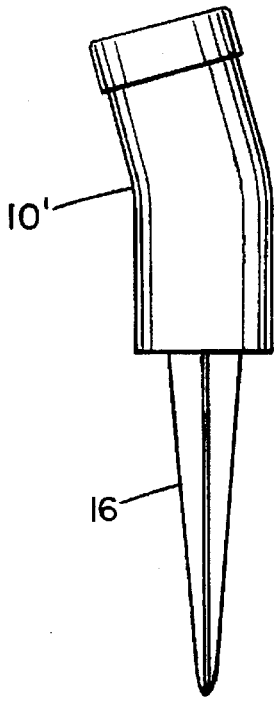
FIG. 3 is a side elevational view of an alternate embodiment of the lighting fixture.

As illustrated in FIGS. 1 and 2, the lighting fixture includes a cylindrical housing 10 with a cap 12 on one end. Housing 10 and cap 12 are preferably made of a durable and aesthetically pleasing material, such as copper. Other corrosion resistant materials may be used as well, including stainless steel, anodized aluminum, powder-coated or painted metal, or high temperature plastics or composites. The housing need not be a straight cylinder. A gradual bend at a shallow angle, e.g., on the order of 15°, as illustrated in FIG. 3, will still allow the full range of axial motion within the housing 10'. Alternatively, the cylinder can have larger angle bends or contours, with the range of axial movement bring limited to the relatively straight segment of the cylinder within which the seating ring 22 and reflector assembly 28 can be moved. A transparent window 14 is attached to the interior of cap 12 at the distal end of housing 10. For vertically-oriented fixture window 14 is preferably domed (convex), as shown in FIG. 1, to allow water to run off. For angled fixtures, i.e., those positioned at an angle or those with contoured housings, the tilt of the top of the fixture should be sufficient to prevent pooling of water an the window. A silicone-based adhesive is preferably used to attach window 14 to form a seal against moisture intrusion. Housing 10 and cap 12 may include any suitable features used in conventional lighting fixtures. For example, although in the illustrated embodiment the end of cap 12 in which window 14 is mounted is perpendicular to the longitudinal axis of housing 10, the end of cap 12 may alternatively be canted to provide window 14 at an angle with respect to the longitudinal axis of housing 10.

A cruciform spike 16 is attached to the other proximal end of housing 10. As shown in FIG. 2, a plastic insert 20, typically injection molded, is retained within housing 10, providing means for attaching the threaded end of spike 16. For standardization, the inside threads of the plastic insert 20 and the outside threads of the spike 16 are ½" NPS pipe thread. A bolt 18, as shown, or preferably a recessed subscrew, extends through the wall of housing 10 into insert 20. The fixture may be installed in an outdoor location by forcing spike 16 into the ground (not shown). The plastic insert 20 closes the proximal end of the housing to provide a seal which is resistant to water intrusion. Alternatively, housing 10 may be recessed into the ground because it is sealed against moisture intrusion, or it may be attached to a mounting bracket for attachment to a post, wall, tree, or other structural surface. For enhanced water tightness, which is particularly important in applications where a portion of the proximal end of the fixture is buried, the plastic insert 20 could be formed with a groove for retaining an O-ring 40 to isolate the reflector assembly from the lower end of the fixture.

In the preferred embodiment, a retaining means comprises a resilient seating ring 22 which is interference-fit within the housing interior wall. Seating ring 22 is split and has two holes 24 and 26 at its ends which permit the insertion of a tool, such as needle-nose pliers or the like, by which the ends of the ring 22 can be squeezed together to loosen it within housing 10. The resiliency of seating ring 22 expands it against the inside walls of housing 10 to retain it in interference or frictional engagement with the housing interior wall.

A reflector assembly 28 is disposed within seating ring 22. Reflector assembly 28 comprises a parabolic glass reflector 30 having a faceted interior surface, a halogen bulb 32 potted in the center of reflector 30, and a bulb receptacle 34. The curvature of the reflector 30 is significant in that it acts as a bearing surface in contact with seating ring 22, allowing it to be rolled around the ring to obtain the desired angle at which the beam of light is to be emitted. The reflector can be tilted at virtually any angle by rolling it on its spherical surface within ring 22. A cone-shaped reflector would also work for this purpose, however, it may not have the range of tilt that a parabolic reflector with its rounded profile would provide. A suitable reflector assembly 28 is commercially available from a number of well-known lighting manufacturers, such as Philips, General Electric and Sylvania, and may conform to ANSI standard MR-16. Wires 36 extend from bulb receptacle 34 and exit the lighting fixture through an opening in the threaded end of spike 16 for connection to the voltage supply (not shown), which may be either a 12 V transformer or 120 VAC.

A retaining clip 38 abuts the end of reflector assembly 28 to secure it in seating ring 22. Retaining clip 38 is preferably a length of stainless steel spring wire formed into an essentially circular shape, with its ends bent upwardly.

To adjust the position of reflector assembly 28, the user first removes cap 12 to allow access to the interior of the fixture. Although in the illustrated embodiment cap 12 is at the end of housing 10 from which the beam is emitted, in other embodiments the opposite end of housing 10 may have a member that a user can remove to allow access.

To adjust the axial position of reflector assembly 28, a user can insert the tips of needle-nose pliers or a similar tool (not shown) into holes 24 and 26 to squeeze the ends of seating ring 22 together and thereby release it from its interference or frictional engagement with the housing interior wall. After moving reflector assembly 28 to the desired axial position, the user can release the tool, thereby allowing seating ring 22 to resiliently expand and re-engage the housing interior wall. A user may move reflector assembly to a position near cap 12, such as that shown in solid line in FIGS. 1 and 2, or a position further from cap 12, such as that indicated in dashed line in FIG. 2.

To adjust the angular position of reflector assembly 28, the user can grip the bent ends of retaining clip 38 to squeeze it and thereby release it from its interference of frictional engagement with the housing interior wall. Reflector assembly 28 can pivot on two axes in seating ring 22, thereby allowing a user to direct the beam throughout a substantial portion of a hemispherical area. A user may pivot reflector assembly 28 to an off-axis position, such as that shown in solid line FIGS. 1 and 2, or to a centered position, as indicated in dashed line in FIG. 2.

When the user has adjusted the position of reflector assembly 28, retaining clip 38 is replaced so that it abuts the upper rim of the reflector 30 and cap 12 is replaced.

As an alternate means to provide axial and pivoting adjustability, the seating ring can be mounted on an axial slide which can be locked by a screw and wing nut combination. The retaining clip 38 could then be placed to maintain angular orientation. However, this may require cutting a slot in the side of the housing, which would allow moisture and dirt to enter the housing.

A fixture with tilt capability only can be formed using a single gimbal to support the reflector assembly, as illustrated in FIG. 4. The gimbal function is provided by a threaded bolt 50 attached to seating ring 52 to provide a pivot point for tilting the reflector assembly 54. The bolt 50 may be press fit into a corresponding bore in the seating ring 52. The bolt 50 passes through an opening 56 in the side of housing 48. The nut 58 or thumb screw can be used to tighten the gimbal once the desired tilt is attained. A retaining clip as described above may also be used to maintain angular orientation. An O-ring, washer or other seal around the bolt 50 and opening 56 would prevent loss of the fixture's water resistant properties.

The lighting fixture of the present invention provides a wide range of beam control, both directability and glare reduction, with the entire mechanism sealed against the elements. The spring-based retention mechanism further provides shock-absorption in the event the fixture is jarred by inadvertent contact. The configuration of the present invention is aesthetically pleasing with clean lines and no external moving parts, so that a significant failure mechanism of prior art fixtures is eliminated.

Obviously, other embodiments and modifications of the present invention will occur readily to those of ordinary skill in the art in view of these teachings. For example, although the portion of housing 10 in which reflector assembly 28 is positionable is cylindrical, other portions of housing 10 may have bends or contours or other features. Therefore, this invention is to be limited only by the following claims which include all such other embodiments and modifications when viewed in conjunction with the above specification and accompanying drawings.

What is claimed is:

1. A lighting fixture, comprising:

a hollow, essentially cylindrical housing having a transparent window at a distal end;

a seating ring disposed at a variable axial location within said housing and having means for retaining said seating ring at a selected axial location;

a reflector assembly in said housing and pivotally seated within said seating ring for adjusting a tilt angle of said reflector assembly; and a retaining clip within said housing and contacting a distal end of said reflector assembly to retain said reflector assembly in said seating ring at a selected tilt angle.

2. The lighting fixture recited in claim 1, wherein said seating ring is resiliently interference-fit within said housing so that said seating ring can be moved to a plurality of different elected axial locations.

3. The lighting fixture recited in claim 2, wherein said seating ring is a metal ring split between two ends.

4. The lighting fixture recited in claim 3, wherein each end of said seating ring has a hole for gripping said seating ring.

5. The lighting fixture recited in claim 1, wherein said retaining clip is resiliently interference-fit within said housing.

6. The lighting fixture recited in claim 5, wherein said retaining clip is an essentially circular metal wire having two ends.

7. The lighting fixture recited in claim 6, wherein each end of said retaining clip is bent.

8. The lighting fixture recited in claim 1, wherein said housing includes an endcap for removably capping said distal end, and said window is disposed in said endcap.

9. The lighting fixture recited in claim 1, further comprising a spike extending into a proximal end of said housing and connected to said housing.

10. The lighting recited in claim 1, further comprising a plastic insert disposed within said housing at a proximal end, said plastic insert having means for substantially sealing said proximal end of said housing against water intrusion.

11. The lighting fixture recited in claim 10 wherein said plastic insert has a bore with a standard pipe thread therein for attachment of a support means.

12. The lighting fixture recited in claim 1, wherein said housing has a shallow angle bend therein.

13. The lighting fixture recited in claim 1 wherein said seating ring has a stud extending radially therefrom, said stud being pivotally disposed within an opening in said housing.

14. A method for adjusting a lighting fixture, comprising the steps of:

removing an endcap from a hollow, essentially cylindrical housing having a transparent window at a distal end and a longitudinal axis;

removing a reflector assembly seated within a seating ring in said housing;

squeezing together two generally adjacent ends of a seating ring resiliently interference-fit within said housing, and simultaneously moving said seating ring axially within said housing;

releasing said ends of said seating ring to allow said seating ring to resiliently expand into interference-fit with said housing;

replacing said reflector assembly in sad seating ring; and replacing said endcap removed from said housing.

15. The method for adjusting a lighting fixture recited in claim 14, herein said endcap caps said distal end of said housing, and said window is disposed in said endcap.

16. A method for adjusting a lighting fixture, comprising the steps of:

removing an endcap from a hollow, essentially cylindrical housing having a transparent window at a distal end and a longitudinal axis;

squeezing together two generally adjacent ends of a retaining clip resiliently interference-fit within said housing;

pivoting a reflector assembly seated within a seating ring in said housing and pivotable in said seating ring on two axes mutually perpendicular to each other and to said longitudinal axis;

disposing a retaining clip in contact with a distal end of said reflector assembly;

releasing said ends of said retaining clip allow said seating ring to resiliently expand into interference-fit with said housing; and replacing said endcap removed from said housing.

17. The method for adjusting a lighting fixture recited in claim 16, wherein said endcap caps said distal end of said housing, and said window is disposed in said endcap.

* * * * *

UNITED STATES PATENT AND TRADEMARK OFFICE

CERTIFICATE OF CORRECTION

PATENT NO. : 5,649,760
DATED : July 22, 1997
INVENTOR(S) : JOSHUA Z. BEADLE

It is certified that error appears in the above-indentified patent and that said Letters Patent is hereby corrected as shown below:

- Column 6, claim 14, line 26, replace "sad" with --said--;
- Column 6, claim 16, line 31, replace "lighting" with --light--;
- Column 6, claim 16, line 37, after "clip" insert --to release said retaining clip from a--; and replace "resiliently" with --resilient--;
- Column 6, claim 16, line 44, replace "a" (first occurrence) with --said--;
- Column 6, claim 16, line 46, after "clip" insert --to--.

Signed and Sealed this

Second Day of December, 1997

*Attest:*

*Attesting Officer*

Bruce Lehman

BRUCE LEHMAN

*Commissioner of Patents and Trademarks*